US009390642B2

(12) United States Patent
Kim et al.

(10) Patent No.: US 9,390,642 B2
(45) Date of Patent: Jul. 12, 2016

(54) FLEXIBLE DISPLAY

(71) Applicant: LG DISPLAY CO., LTD., Seoul (KR)

(72) Inventors: Taegung Kim, Gyeonggi-do (KR); Jinyoung Bang, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 103 days.

(21) Appl. No.: 13/762,566

(22) Filed: Feb. 8, 2013

(65) Prior Publication Data

US 2013/0207946 A1 Aug. 15, 2013

(30) Foreign Application Priority Data

Feb. 13, 2012 (KR) ..... 10-2012-0014436

(51) Int. Cl.
*G09G 3/00* (2006.01)
*G09G 3/32* (2016.01)

(52) U.S. Cl.
CPC ..... *G09G 3/00* (2013.01); *G09G 3/3225* (2013.01); *G09G 2320/0261* (2013.01); *G09G 2354/00* (2013.01); *G09G 2360/144* (2013.01); *G09G 2380/02* (2013.01)

(58) Field of Classification Search
CPC ... G09G 3/00; G09G 3/3225; G09G 2354/00; G09G 2360/144; G09G 2380/02; G09G 2320/0261
See application file for complete search history.

(56) References Cited

U.S. PATENT DOCUMENTS 4,601,514 A * 7/1986 Meiller ..... 297/284.4
5,174,526 A * 12/1992 Kanigowski ..... 244/122 R
2002/0084891 A1* 7/2002 Mankins ..... B60Q 1/2611 340/425.5
2006/0213281 A1* 9/2006 Doak et al. ..... 73/849
2008/0018631 A1* 1/2008 Hioki et al. ..... 345/206
2008/0055831 A1* 3/2008 Satoh ..... G02F 1/133305 361/600
2008/0216585 A1* 9/2008 Cipra ..... G01N 3/20 73/851
2010/0188422 A1* 7/2010 Shingai et al. ..... 345/647
2011/0007042 A1* 1/2011 Miyaguchi ..... 345/204
2011/0095975 A1 4/2011 Hwang et al.
2011/0095999 A1* 4/2011 Hayton ..... G06F 1/1626 345/173

(Continued)

FOREIGN PATENT DOCUMENTS

CN 102055821 A 5/2011
JP 3276256 B2 2/2002

(Continued)

OTHER PUBLICATIONS

The First Office Action dated Aug. 27, 2014 from The State Intellectual Property Office of the People's Republic of China in counterpart Chinese application No. 201310047378.2.
Office Action dated Oct. 20, 2014 from the Korean Patent Office in counterpart Korean application No. 10-2012-0014436.

*Primary Examiner* — Aneeta Yodichkas
*Assistant Examiner* — Richard Hong
(74) *Attorney, Agent, or Firm* — Morgan, Lewis & Bockius LLP

(57) ABSTRACT

A flexible display includes a flexible display panel, a curved formation unit for forming a curved surface of the flexible display panel, and a curved signal generating unit which supplies a curved signal to the curved formation unit so that a radius of curvature of the flexible display panel is controlled based on at least one of user setting conditions, external environmental conditions, and displaying image conditions. The curved formation unit forms the curved surface of the flexible display panel in response to the curved signal.

12 Claims, 16 Drawing Sheets

(56) References Cited

U.S. PATENT DOCUMENTS

| | | | | |
|---|---|---|---|---|
| 2011/0115887 | A1* | 5/2011 | Yoo et al. | 348/51 |
| 2011/0187681 | A1 | 8/2011 | Kim et al. | |
| 2011/0273906 | A1 | 11/2011 | Nichol et al. | |
| 2012/0235894 | A1* | 9/2012 | Phillips | G09G 3/36 345/156 |

FOREIGN PATENT DOCUMENTS

| | | | | | |
|---|---|---|---|---|---|
| JP | 2006023676 | A | * | 1/2006 | G02B 27/22 |
| JP | 2009109812 | A | * | 5/2009 | G09F 9/00 |
| KR | 20110088872 | A | | 8/2011 | |

* cited by examiner (a)

(b)

FLEXIBLE DISPLAY

This application claims the benefit of Korean Patent Application No. 10-2012-0014436 filed on Feb. 13, 2012, the entire contents of which is incorporated herein by reference for all purposes as if fully set forth herein.

BACKGROUND OF THE INVENTION

1. Field of the Invention

Embodiments of the invention relate to a flexible display.

2. Discussion of the Related Art

The market of flat panel displays used as media between users and information is increasing with the development of information technology. Hence, the use of flat panel displays, such as an organic light emitting diode (OLED) display, a liquid crystal display (LCD), an electrophoretic display, and a plasma display panel (PDP), is increasing.

Out of the flat panel displays, the OLED display and the electrophoretic display may easily achieve a thin profile and also may be used as a flexible display through their flexibility.

The flexible display may be used as a stereoscopic display, which implements a stereoscopic image using conversion elements including a parallax barrier, shutter glasses, a patterned retarder, etc., as well as the flat panel display.

As described above, characteristics of the flexible display may be variously used. In particular, the flexible display may be useful in an image information providing device, for example, televisions or monitors.

However, the flexible displays, which have been recently commercialized and studied, have slightly used flexible characteristics of a display panel thereof. Thus, a study is necessary to provide a convenient and optimum viewing environment for the user using the flexible characteristics of the flexible display.

SUMMARY OF THE INVENTION

In one aspect, there is a flexible display including a flexible display panel, a curved formation unit configured to form a curved surface of the flexible display panel, and a curved signal generating unit configured to supply a curved signal to the curved formation unit so that a radius of curvature of the flexible display panel is controlled based on at least one of user setting conditions, external environmental conditions, and displaying image conditions, wherein the curved formation unit forms the curved surface of the flexible display panel in response to the curved signal.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Example embodiments of the invention will be described with reference to FIGS. 1 to 20.

Figure 1:
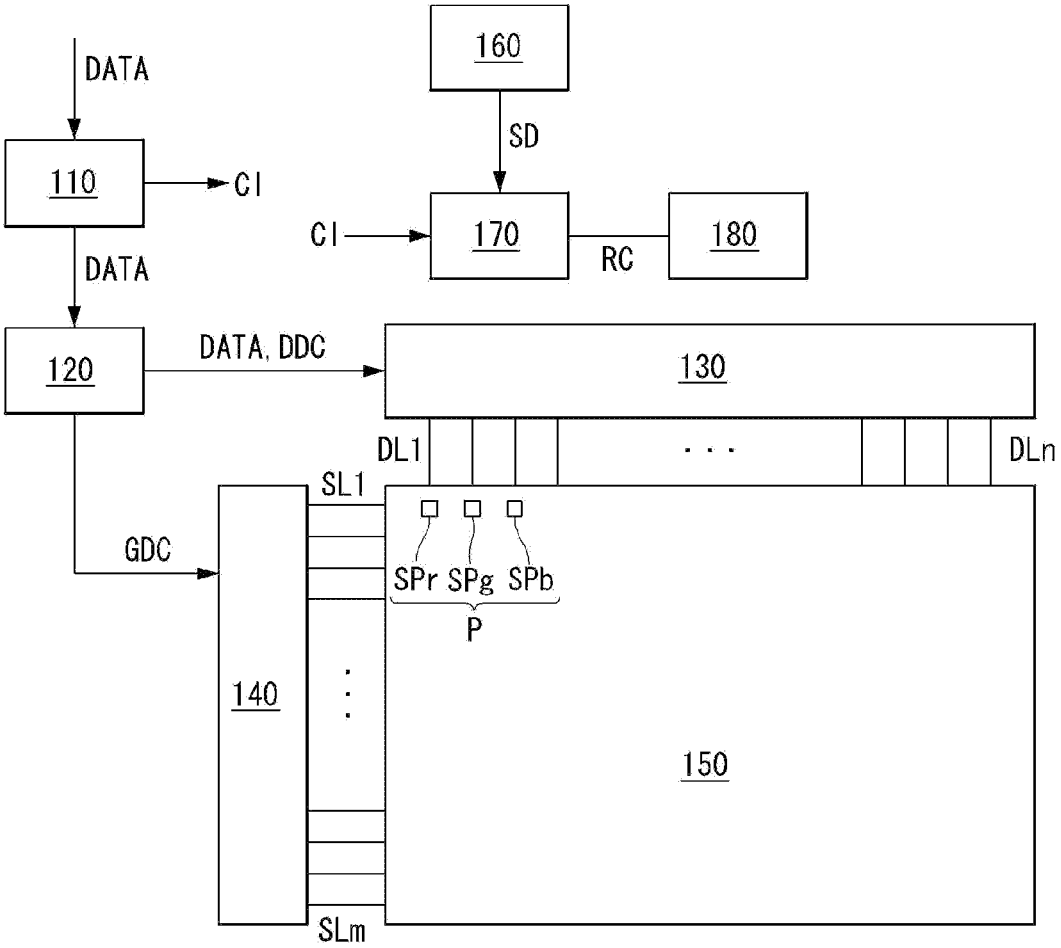
FIG. 1 is a schematic bock diagram of a flexible display according to an example embodiment of the invention.
Figure 2:
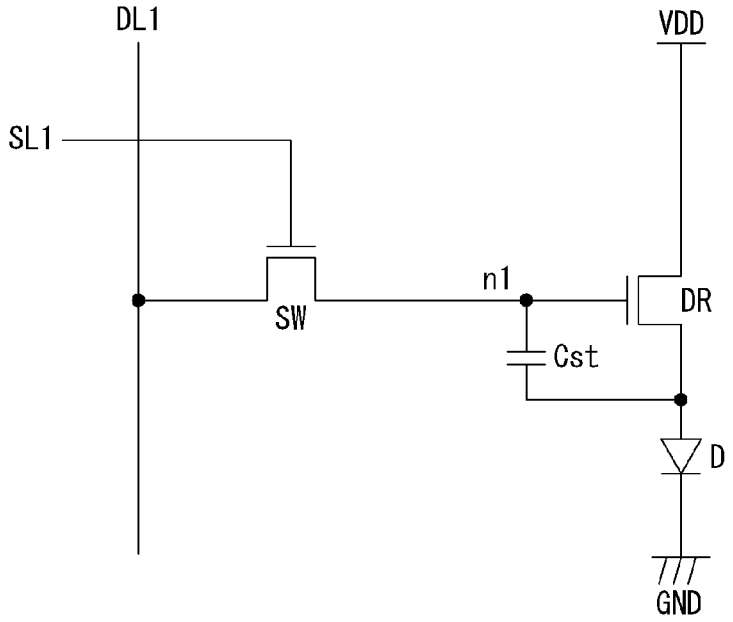
FIG. 2 illustrates a circuit configuration of a subpixel shown in FIG. 1.
Figure 3:
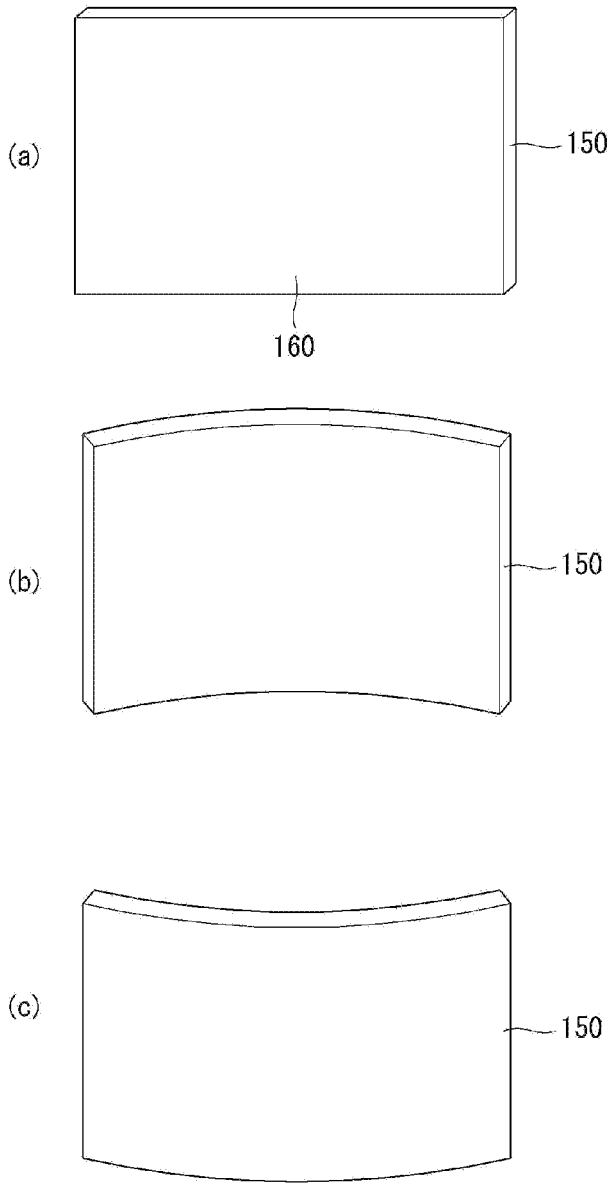
FIG. 3 illustrates an operation of a flexible display panel according to an example embodiment of the invention.

FIG. 1 is a schematic bock diagram of a flexible display according to an example embodiment of the invention. FIG. 2 illustrates a circuit configuration of a subpixel shown in FIG. 1. FIG. 3 illustrates an operation of a flexible display panel according to the embodiment of the invention.

As shown in FIG. 1, the flexible display according to the embodiment of the invention includes an image board unit 110, a timing controller 120, a data driver 130, a gate driver 140, a flexible display panel 150, a sensing unit 160, a curved signal generating unit 170, and a curved formation unit 180.

The image board unit 110 outputs timing signals including a vertical sync signal, a horizontal sync signal, a data enable signal, a main clock, etc. and a data signal DATA. In a two-dimensional (2D) mode, the image board unit 110 performs a 2D image processing for generating a 2D data signal. In a three-dimensional (3D) mode, the image board unit 110 performs a 3D image processing for generating a 3D data signal. The image board unit 110 receives the data signal DATA corresponding to a broadcasting signal using a broadcasting receiving module (or internet communication module), etc. In this instance, the image board unit 110 may output a channel information CI about the received broadcasting signal. The image board unit 110 selects the 2D or 3D mode in response to a user selection input through a user interface and generates the 2D or 3D data signal corresponding to the 2D or 3D mode. The image board unit 110 then supplies the 2D or 3D data signal to the timing controller 120. Examples of the user interface include a user input means, for example, an on-screen display (OSD), a remote controller, a keyboard, and a mouse.

The timing controller 120 receives the timing signals and the data signal DATA from the image board unit 110. The timing controller 120 generates a data timing signal DDC and a gate timing signal GDC based on the timing signals received from the image board unit 110. The timing controller 120 outputs the 2D data signal in the 2D mode and outputs the 3D data signal in the 3D mode. The timing controller 120 supplies the data timing signal DDC and the data signal DATA to the data driver 130 and supplies the gate timing signal GDC to the gate driver 140.

The data driver 130 outputs the data signal DATA in response to the data timing signal DDC received from the timing controller 120. The data driver 130 converts the data signal received from the timing controller 120 based on a gamma voltage and supplies the converted data signal to data lines DL1 to DLn. The data driver 130 may be mounted on the flexible display panel 150 in the form of an integrated circuit (IC) or may be mounted on an external circuit substrate connected to the flexible display panel 150.

The gate driver 140 outputs a gate signal in response to the gate timing signal GDC received from the timing controller 120. More specifically, the gate driver 140 generates the gate signal, of which a level is shifted to a voltage capable of driving thin film transistors (TFTs) included in a pixel P. The gate driver 140 then supplies the gate signal to gate lines SL1 to SLm. The gate driver 140 may be mounted on the flexible display panel 150 in the form of an IC or may be mounted on the flexible display panel 150 in the form of a gate-in panel.

The flexible display panel 150 may be implemented as a display panel which may easily achieve a thin profile and have flexibility, for example, an organic light emitting diode (OLED) display panel or an electrophoretic display panel. In the OLED display panel usable as the flexible display panel 150, three subpixels including red, green, and blue subpixels SPr, SPg, and SPb (or four subpixels including the three subpixels SPr, SPg, and SPb and a white subpixel) form one pixel P. The OLED display panel may be classified into a top emission type OLED display panel, a bottom emission type OLED display panel, and a dual emission type OLED display panel based on its structure.

As shown in FIG. 2, the subpixel included in the OLED display panel includes a switching transistor SW, a driving transistor DR, a capacitor Cst, and an organic light emitting diode D. The switching transistor SW is driven in response to the gate signal supplied through the first gate line SL1, so that the data signal supplied through the first data line DL1 is supplied to a first node n1 and is stored in the capacitor Cst as a data voltage. The driving transistor DR is driven in response to the data voltage stored in the capacitor Cst, so that a driving current flows between a first power terminal VDD and a second power terminal GND. The organic light emitting diode D is driven in response to the driving current formed by the drive of the driving transistor DR, thereby emitting light. The subpixel included in the OLED display panel has a circuit configuration of 2T(transistor)1C(capacitor) shown in FIG. 2. Alternatively, the subpixel included in the OLED display panel may have circuit configurations of 3T1C, 4T2C, 5T2C, and 7T2C, each of which includes a compensation circuit, etc.

The sensing unit 160 senses external environmental conditions of the flexible display panel 150. The external environment conditions include at least one of a position of a viewer which watches the flexible display panel 150, the number of viewers, a position of an outermost viewer adjacent to the viewer, a position of another viewer closest to the viewer, and an ambient brightness of the flexible display panel 150. The sensing unit 160 may be implemented as a camera or a sensor (for example, an infrared sensor and a position sensor) capable of sensing the external environmental conditions. The sensing unit 160 is formed on a display surface (i.e., a front surface or a lateral surface) of the flexible display panel 150. The sensing unit 160 senses the external environmental conditions of the flexible display panel 150 and supplies sensing data SD corresponding to the sensed external environment conditions to the curved signal generating unit 170.

The curved signal generating unit 170 generates a curved signal RC based on the sensing data SD received from the sensing unit 160. Further, the curved signal generating unit 170 generates the curved signal RC based on the channel information CI about the data signal DATA. Further, the curved signal generating unit 170 generates the curved signal RC based on a user setting signal input through the user interface. Thus, the curved signal generating unit 170 generates the curved signal RC in an automatic manner (for example, external environmental conditions and displaying image conditions) or in a passive manner (for example, user setting conditions).

The curved signal generating unit 170 supplies the curved signal RC to the curved formation unit 180, so that a radius of curvature of the flexible display panel 150 is controlled based on at least one of the external environmental conditions, the displaying image conditions, and the user setting conditions.

The curved formation unit 180 makes the flexible display panel 150 curved. The curved formation unit 180 is installed on a back surface of the flexible display panel 150 in a wall type or is installed on a support surface of the flexible display panel 150 in a stand type. The curved formation unit 180 forms a curved surface of the flexible display panel 150 in response to the curved signal RC received from the curved signal generating unit 170.

The flexible display according to the embodiment of the invention is configured as described above, and thus the flexible display panel 150 is manufactured in a plane type as shown in (a) of FIG. 3, in a concave type as shown in (b) of FIG. 3, and in a convex type as shown in (c) of FIG. 3. In FIG. 3, (a) shows an example where the sensing unit 160 is installed in the rear (or lower side) of the display surface of the flexible display panel 150.

The flexible display according to the embodiment of the invention forms the curved surface of the flexible display panel 150 based on the external environmental conditions or the displaying image conditions, thereby increasing the immersion of an image displayed on the flexible display panel 150. Further, the flexible display according to the embodiment of the invention freely changes the curved surface of the flexible display panel 150, thereby providing an optimum image to the viewer.

Various operational examples of the flexible display according to the embodiment of the invention are described below. Because an operation of the flexible display based on the user setting conditions is performed by the direct control of the curved signal generating unit 170 using the user interface, the description of the operation is omitted.

Figure 4:
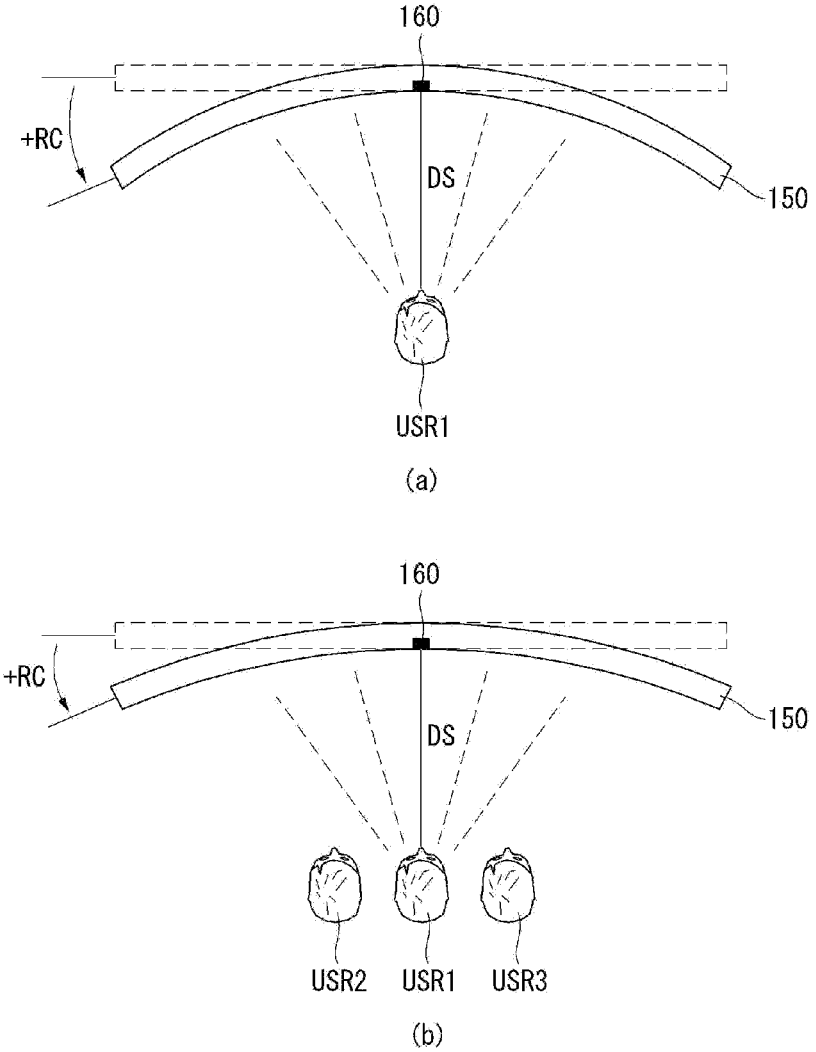
FIG. 4 illustrates an operational example of a flexible display panel based on a viewer.

FIG. 4 illustrates an operational example of the flexible display panel based on a viewer.

As shown in FIG. 1 and (a) of FIG. 4, the flexible display panel 150, on which an image is displayed, is bent in a direction, in which a viewer USR1 is positioned. In this instance, the surface of the flexible display panel 150 is bent from a flat surface to a concave surface based on a position condition of the viewer USR1.

As shown in FIG. 1 and (b) of FIG. 4, the flexible display panel 150, on which an image is displayed, is bent in a direction, in which several viewers USR1 to USR3 are positioned. In this instance, the surface of the flexible display panel 150 is bent from a flat surface to a concave based on a position condition of the several viewers USR1 to USR3.

The sensing unit 160 senses the position of the viewer USR1 and supplies sensing data SD to the curved signal generating unit 170, so as to perform the above-described operation. The curved signal generating unit 170 generates a first curved signal +RC based on the sensing data SD and supplies the first curved signal +RC to the curved formation unit 180. The curved formation unit 180 inwardly bends the surface of the flexible display panel 150 based on the first curved signal +RC.

The sensing unit 160 may form a distance (1) between the flexible display panel 150 and the viewer or a distance DS. Alternately, the sensing unit 160 may form a distance (2) between both eyes of the viewer as the sensing data SD. For example, the sensing unit 160 may be implemented as the infrared sensor so as to sense the distance (1). Further, the sensing unit 160 may be implemented as the camera so as to sense the distance (2). A coordinate value (x, y) may be used to measure the distance between both eyes of the viewer using the camera. However, the embodiment of the invention is not limited thereto.

In the flexible display according to the embodiment of the invention, there may be a difference between the radiuses of curvatures forming the curved surface of the flexible display panel 150 depending on the number of viewers, which watch the flexible display panel 150. Namely, the first curved signal +RC generated under the conditions shown in (a) of FIG. 4 may be different from the first curved signal +RC generated under the conditions shown in (b) of FIG. 4.

Figure 5:
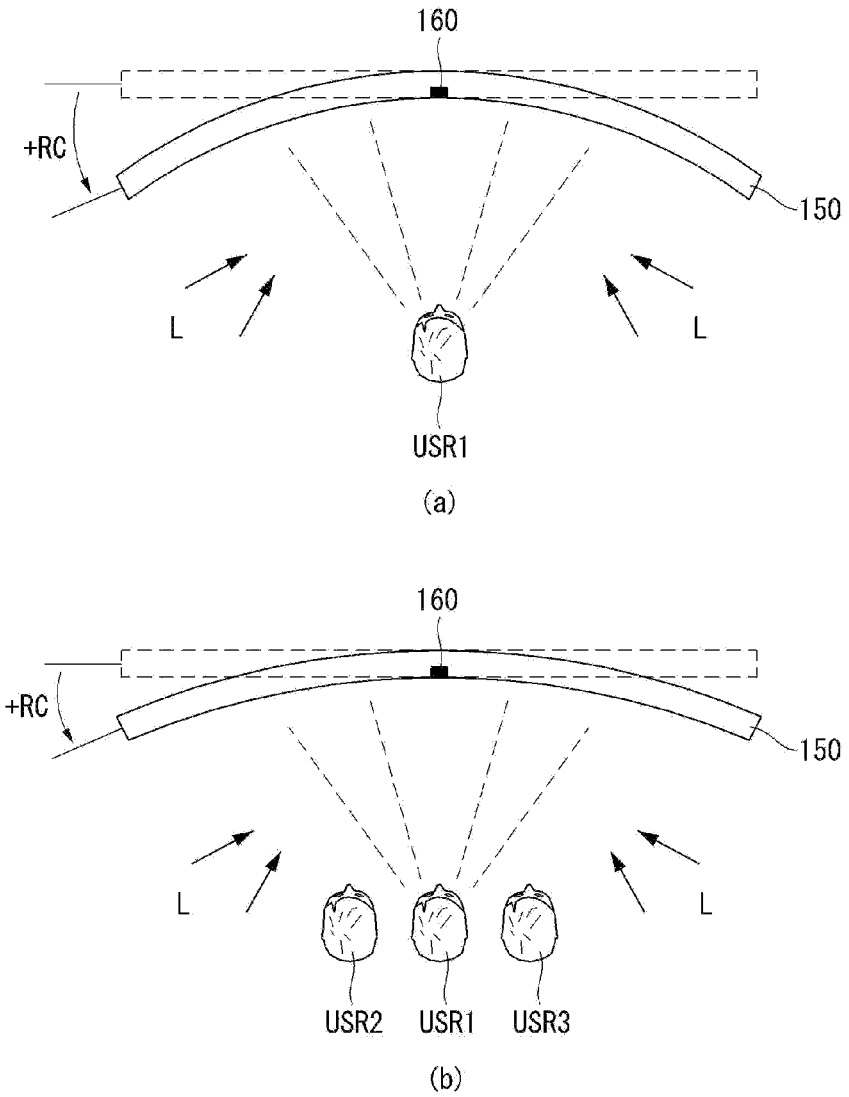
FIG. 5 illustrates an operational example of a flexible display panel based on an ambient brightness.

FIG. 5 illustrates an operational example of the flexible display panel based on an ambient brightness.

As shown in FIG. 1 and (a) of FIG. 5, the flexible display panel 150, on which an image is displayed, is bent in a direction, in which a viewer USR1 is positioned. In this instance, the surface of the flexible display panel 150 is bent from a flat surface to a concave surface based on an ambient brightness L (for example, an illuminance difference of external light, etc.).

As shown in FIG. 1 and (b) of FIG. 5, the flexible display panel 150, on which an image is displayed, is bent in a direction, in which several viewers USR1 to USR3 are positioned. In this instance, the surface of the flexible display panel 150 is bent from a flat surface to a concave surface based on the ambient brightness L.

The sensing unit 160 senses the ambient brightness L and supplies sensing data SD to the curved signal generating unit 170, so as to perform the above-described operation. The curved signal generating unit 170 generates a first curved signal +RC based on the sensing data SD and supplies the first curved signal +RC to the curved formation unit 180. The curved formation unit 180 inwardly bends the surface of the flexible display panel 150 based on the first curved signal +RC.

The sensing unit 160 may form a distance (1) between the flexible display panel 150 and the viewer or a distance DS. Alternately, the sensing unit 160 may form a distance (2) between both eyes of the viewer as well as the ambient brightness L as the sensing data SD. For example, the sensing unit 160 may be implemented as the camera and the infrared sensor so as to sense the ambient brightness L and the distance (1) or (2).

In the flexible display according to the embodiment of the invention, there may be a difference between the radiuses of curvatures forming the curved surface of the flexible display panel 150 depending on the ambient brightness L of the flexible display panel 150 and the number of viewers, which watch the flexible display panel 150. Namely, the first curved signal +RC generated under the conditions shown in (a) of FIG. 5 may be different from the first curved signal +RC generated under the conditions shown in (b) of FIG. 5.

Figure 6:
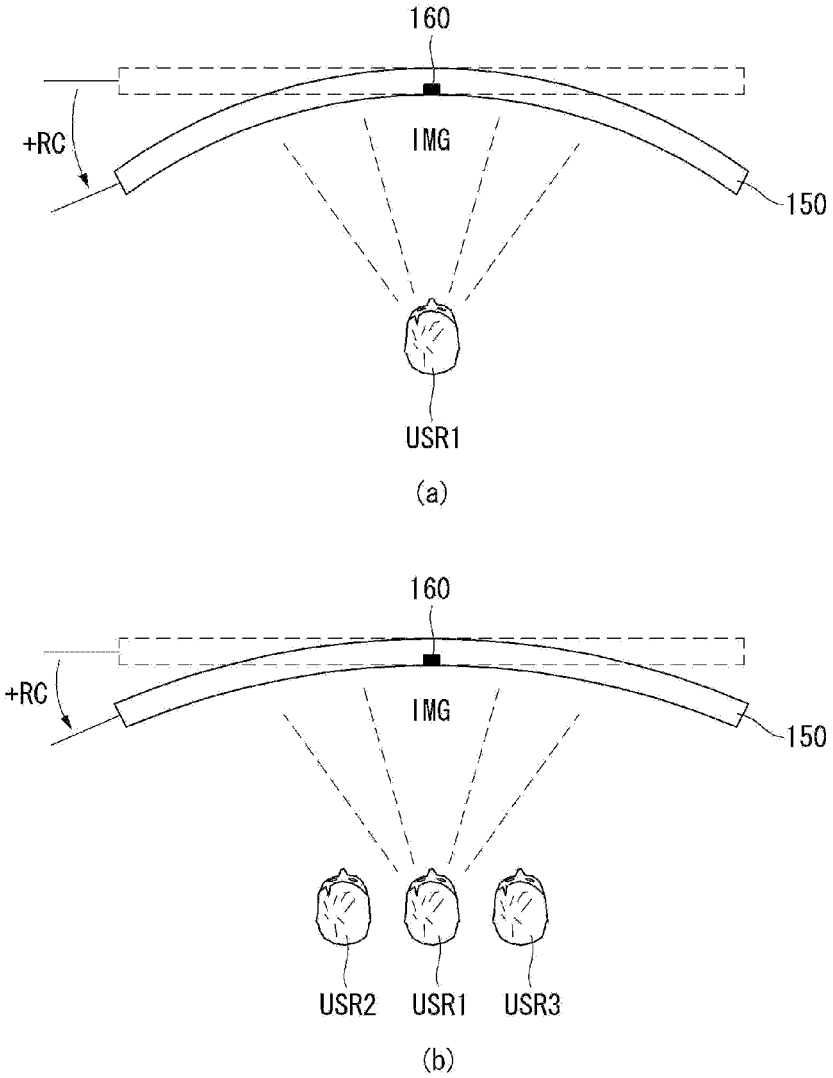
FIG. 6 illustrates an operational example of a flexible display panel based on a kind of image.

FIG. 6 illustrates an operational example of the flexible display panel based on a kind of image.

As shown in FIG. 1 and (a) of FIG. 6, the flexible display panel 150, on which an image is displayed, is bent in a direction, in which a viewer USR1 is positioned. In this instance, the surface of the flexible display panel 150 is bent from a flat surface to a concave surface based on a kind 'IMG' of image.

As shown in FIG. 1 and (b) of FIG. 6, the flexible display panel 150, on which an image is displayed, is bent in a direction, in which several viewers USR1 to USR3 are positioned. In this instance, the surface of the flexible display panel 150 is bent from a flat surface to a concave surface based on a kind 'IMG' of image.

The sensing unit 160 senses the kind 'IMG' of image and supplies sensing data SD to the curved signal generating unit 170, so as to perform the above-described operation. The curved signal generating unit 170 generates a first curved signal +RC based on the sensing data SD and supplies the first curved signal +RC to the curved formation unit 180. The curved formation unit 180 inwardly bends the surface of the flexible display panel 150 based on the first curved signal +RC.

The sensing unit 160 may form a distance (1) between the flexible display panel 150 and the viewer or a distance DS. Alternately, the sensing unit 160 may form a distance (2) between both eyes of the viewer as well as the kind 'IMG' of image as the sensing data SD. For example, the sensing unit 160 may be implemented as the camera and the infrared sensor so as to sense the kind 'IMG' of image and the distance (1) or (2).

In the flexible display according to the embodiment of the invention, there may be a difference between the radiuses of curvatures forming the curved surface of the flexible display panel 150 depending on the kind 'IMG' of image displayed on the flexible display panel 150 and the number of viewers, which watch the flexible display panel 150. Namely, the first curved signal +RC generated under the conditions shown in (a) of FIG. 6 may be different from the first curved signal +RC generated under the conditions shown in (b) of FIG. 6.

Figure 7:
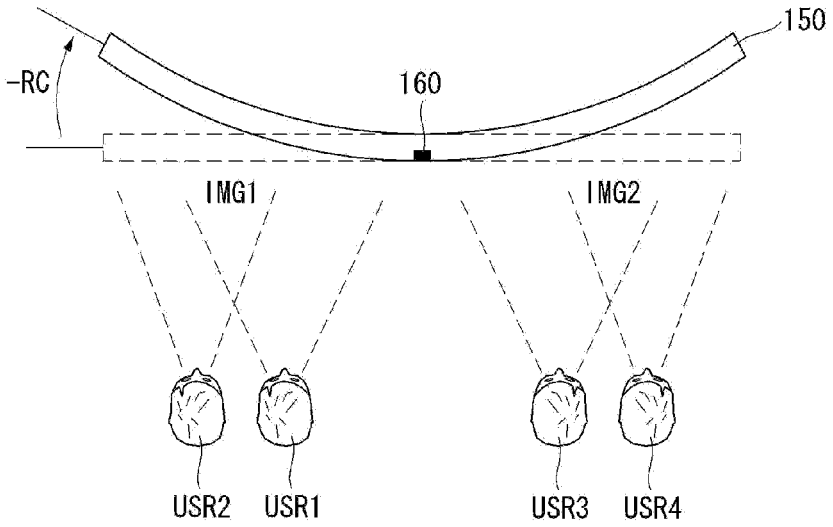
FIG. 7 illustrates an operational example of a flexible display panel based on a kind of image and a viewer.

FIG. 7 illustrates an operational example of the flexible display panel based on a kind of image and a viewer.

As shown in FIGS. 1 and 7, the flexible display panel 150, on which an image is displayed, is bent in the opposite direction of a direction, in which several viewers USR1 to USR4 are positioned. In this instance, the surface of the flexible display panel 150 is bent from a flat surface to a convex surface based on kinds IMG1 and IMG2 of image and positions of the viewers USR1 to USR4, so that the several viewers USR1 to USR4 can watch different images.

The sensing unit 160 senses the kinds IMG1 and IMG2 of image and supplies sensing data SD to the curved signal generating unit 170, so as to perform the above-described operation. The curved signal generating unit 170 generates a second curved signal −RC based on the sensing data SD and supplies the second curved signal −RC to the curved formation unit 180. The curved formation unit 180 outwardly bends the surface of the flexible display panel 150 based on the second curved signal −RC.

The sensing unit 160 may form a distance (1) between the flexible display panel 150 and the viewer or a distance DS. Alternately, sensing unit 160 may form a distance (2) between both eyes of the viewer as well as the kinds IMG1 and IMG2 of image as the sensing data SD.

In the flexible display according to the embodiment of the invention, there may be a difference between the radiuses of curvatures forming the curved surface of the flexible display panel 150 depending on the kinds IMG1 and IMG2 of image displayed on the flexible display panel 150 and the positions of viewers, which watch the flexible display panel 150.

As described above, the curved formation unit 180 bends and stretches a left portion and a right portion based on a middle point of the flexible display panel 150 or bends and stretches the middle point of the flexible display panel 150 in response to the curved signal RC.

The curved formation unit 180 performing the above-described operations includes a tool part and a driving part. The tool part of the curved formation unit 180 fixes the flexible display panel 150, and the driving part of the curved formation unit 180 bends the flexible display panel 150 along with the tool part. As described above, because the curved formation unit 180 requires the tool part, the flexible display panel 150 may be damaged by an operation of the tool part. Thus, the flexible display panel 150 may be configured so that it is not damaged by the operation of the curved formation unit 180.

Figure 8:
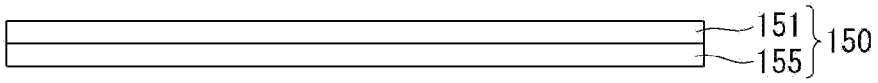
FIG. 8 illustrates a configuration of a flexible display panel according to an example embodiment of the invention.

FIG. 8 illustrates a configuration of the flexible display panel according to the embodiment of the invention.

As shown in FIG. 8, the flexible display panel 150 according to the embodiment of the invention includes a display panel 151 displaying an image and a back cover 155 attached to a back surface of the display panel 151. The back cover 155 is attached to the back surface of the display panel 151 while the display panel 151 and the back cover 155 are held in a flat state. The back cover 155 may be formed of a material having thermal conductivity and flexibility. This will be described in detail later.

A configuration and an operation of the curved formation unit 180 are described in detail below.

Figure 9:
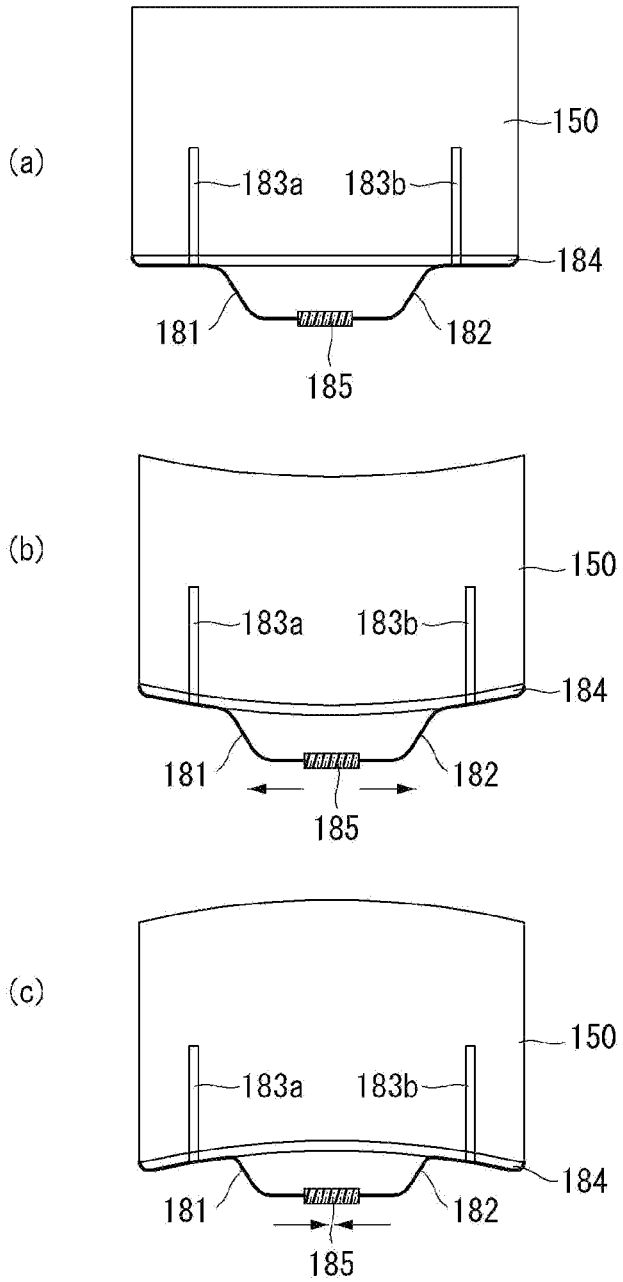
FIG. 9 illustrates a first example of a configuration of a curved formation unit according to an example embodiment of the invention.
Figure 10:
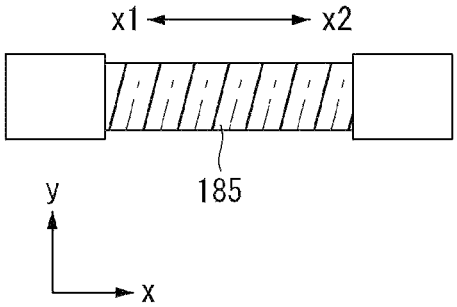
FIG. 10 illustrates an operation of a driver shown in FIG. 9.

FIG. 9 illustrates a first example of a configuration of the curved formation unit according to the embodiment of the invention. FIG. 10 illustrates an operation of a driver shown in FIG. 9.

As shown in FIG. 9, a curved formation unit includes connectors 181 and 182, supporters 183*a* and 183*b*, a fixer 184, and a driver 185. The connectors 181 and 182 are respectively installed on the left and right sides of the back surface of the flexible display panel 150. The supporters 183*a* and 183*b* are respectively installed on the left and right sides of the flexible display panel 150, so that tension of the connectors 181 and 182 is efficiently transferred to the flexible display panel 150. The fixer 184 is installed at the bottom of the back surface of the flexible display panel 150, so as to stably fix the connectors 181 and 182. The driver 185 varies its length in response to the curved signal and is installed on the back surface of the flexible display panel 150 so that the tension is formed in the connectors 181 and 182. The connectors 181 and 182 may be formed of a solid metal or aluminum capable of forming the tension. Other materials may be used for the connectors 181 and 182.

As shown in FIG. 10, the driver 185 is configured as a device capable of varying its length using a motor manner (including a motor, a screw, a gear, etc.), a vapor (or air) pressure manner, a fluid pressure manner, etc. When the driver 185 is configured in the motor manner, the driver 185 varies its length by increasing or reducing a length of the screw depending on a rotation direction of the motor. When the driver 185 is configured in the vapor pressure manner, the driver 185 varies its length by increasing or reducing a length of the screw depending on the vapor pressure. When the driver 185 is configured in the fluid pressure manner, the driver 185 varies its length by increasing or reducing a length of the screw depending on the fluid pressure. Alternatively, the driver 185 may be configured as various devices capable of varying its length.

As shown in FIGS. 9 and 10, when the curved signal generating unit 170 supplies the first curved signal to the driver 185, the driver 185 increases its length while the driver 185 is driven in an x2 direction. The connectors 181 and 182 form a propellent force as the length of the driver 185 increases. Hence, the surface of the flexible display panel 150 is bent from a flat surface shown in (a) of FIG. 9 to a concave surface shown in (b) of FIG. 9.

On the other hand, when the curved signal generating unit 170 supplies the second curved signal to the driver 185, the driver 185 reduces its length while the driver 185 is driven in an x1 direction. The connectors 181 and 182 form an attractive force as the length of the driver 185 decreases. Hence, the surface of the flexible display panel 150 is bent from the flat surface shown in (a) of FIG. 9 to a convex surface shown in (c) of FIG. 9.

Figure 11:
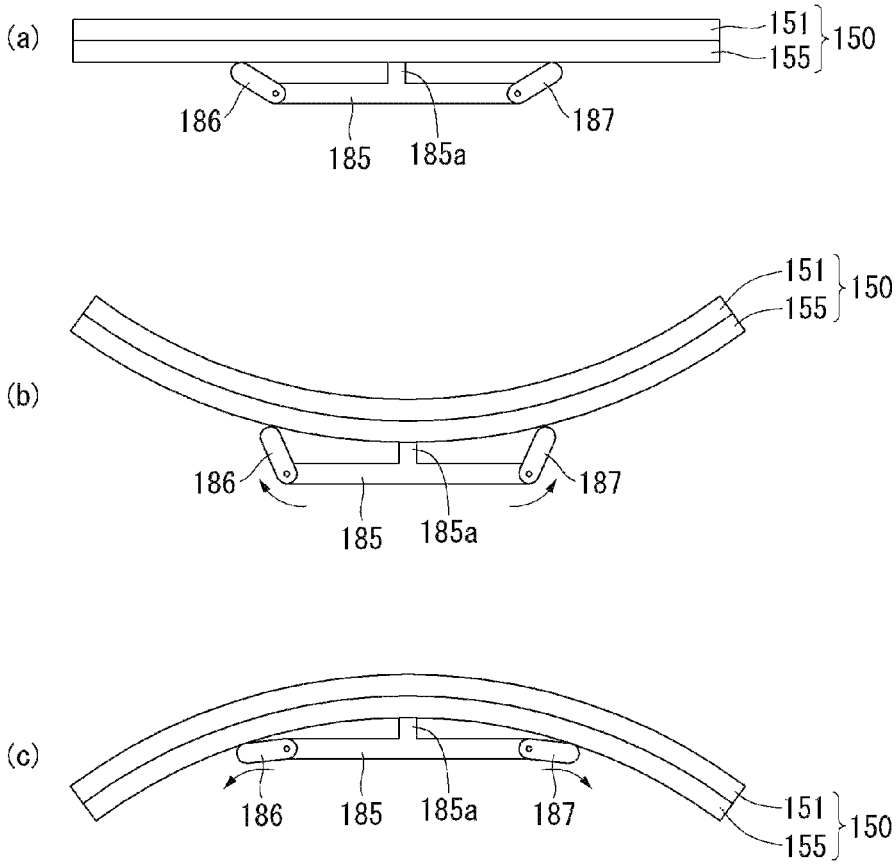
FIG. 11 illustrates a second example of a configuration of a curved formation unit according to an example embodiment of the invention.
Figure 12:
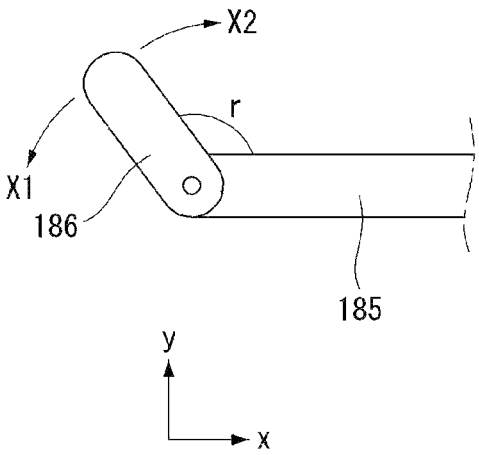
FIG. 12 illustrates an operation of a driver shown in FIG. 11.

FIG. 11 illustrates a second example of the configuration of the curved formation unit according to the embodiment of the invention. FIG. 12 illustrates an operation of a driver shown in FIG. 11.

As shown in FIG. 11, a curved formation unit includes supporters 186 and 187 and a driver 185. The supporters 186 and 187 are respectively installed on the left and right sides of the back surface of the flexible display panel 150. The driver 185 includes a fixer 185*a*, of which a portion is fixed to the center of the back surface of the flexible display panel 150 so as to bend the supporters 186 and 187 in response to the curved signal. The driver 185 has a T-shape.

As shown in FIG. 12, the driver 185 is a joint folding device which is able to bend or stretch the supporters 186 and 187 in a motor manner. Alternatively, the driver 185 may be configured as various devices capable of bending or stretching the supporters 186 and 187.

As shown in FIGS. 11 and 12, when the curved signal generating unit 170 supplies the first curved signal to the driver 185, the driver 185 reduces angles 'r' between the supporters 186 and 187 and the driver 185 while the driver 185 is driven in an x2 direction. The supporters 186 and 187 form a propellent force as the angles 'r' decrease. Hence, the surface of the flexible display panel 150 is bent from a flat surface shown in (a) of FIG. 11 to a concave surface shown in (b) of FIG. 11.

On the other hand, when the curved signal generating unit 170 supplies the second curved signal to the driver 185, the driver 185 increases the angles 'r' between the supporters 186 and 187 and the driver 185 while the driver 185 is driven in an x1 direction. The supporters 186 and 187 form an attractive force as the angles 'r' increases. Hence, the surface of the flexible display panel 150 is bent from the flat surface shown in (a) of FIG. 11 to a convex surface shown in (c) of FIG. 11.

Figure 13:
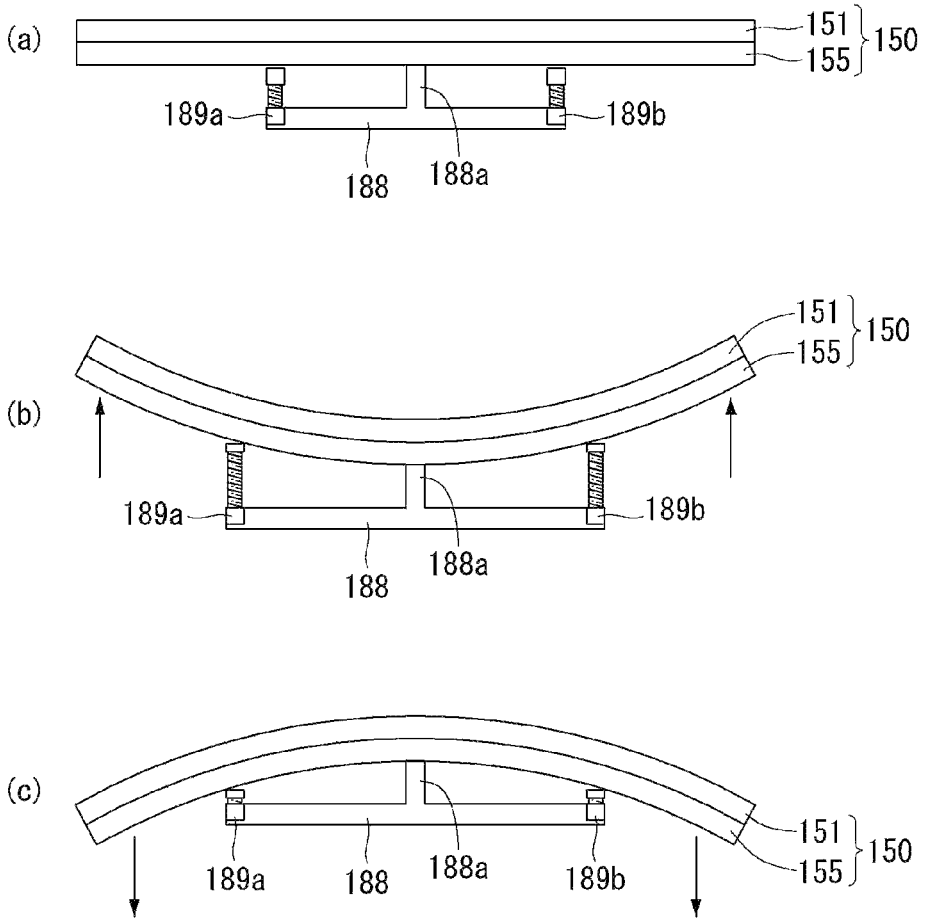
FIG. 13 illustrates a third example of a configuration of a curved formation unit according to an example embodiment of the invention.
Figure 14:
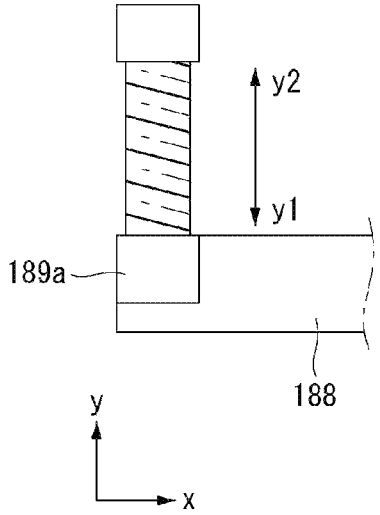
FIG. 14 illustrates an operation of a driver shown in FIG. 13.

FIG. 13 illustrates a third example of the configuration of the curved formation unit according to the embodiment of the invention. FIG. 14 illustrates an operation of a driver shown in FIG. 13.

As shown in FIG. 13, a curved formation unit includes a supporter 188 and drivers 189*a* and 189*b*. The supporter 188 includes a fixer 188*a*, of which a portion is fixed to the center of the back surface of the flexible display panel 150. The supporter 188 has a T-shape. The drivers 189*a* and 189*b* are respectively installed on the left and right sides of the back surface of the flexible display panel 150, so as to vary their lengths in response to the curved signal. Namely, the drivers 189*a* and 189*b* are vertically installed on the supporter 188.

As shown in FIG. 14, the drivers 189*a* and 189*b* are configured as a device capable of varying their lengths using a motor manner, an air pressure manner, a fluid pressure manner, etc. When the drivers 189*a* and 189*b* are configured in the motor manner, the drivers 189*a* and 189*b* vary their lengths by increasing or reducing a length of a screw depending on a rotation direction of a motor. When the drivers 189*a* and 189*b* are configured in the air pressure manner, the drivers 189*a* and 189*b* vary their lengths by increasing or reducing a length of the screw depending on the air pressure. When the drivers 189*a* and 189*b* are configured in the fluid pressure manner, the drivers 189*a* and 189*b* vary their lengths by increasing or reducing a length of the screw depending on the fluid pressure. Alternatively, the drivers 189*a* and 189*b* may be configured as various devices capable of varying their lengths.

As shown in FIGS. 13 and 14, when the curved signal generating unit 170 supplies the first curved signal to the drivers 189*a* and 189*b*, the drivers 189*a* and 189*b* increase their lengths while the drivers 189*a* and 189*b* are driven in an y2 direction. The drivers 189*a* and 189*b* form a propellent force as their lengths increase. Hence, the surface of the flexible display panel 150 is bent from a flat surface shown in (a) of FIG. 13 to a concave surface shown in (b) of FIG. 13.

On the other hand, when the curved signal generating unit 170 supplies the second curved signal to the drivers 189*a* and 189*b*, the drivers 189*a* and 189*b* reduce their lengths while the drivers 189*a* and 189*b* are driven in an y1 direction. The drivers 189*a* and 189*b* form an attractive force as their lengths decrease. Hence, the surface of the flexible display panel 150 is bent from the flat surface shown in (a) of FIG. 13 to a convex surface shown in (c) of FIG. 13.

Figure 15:
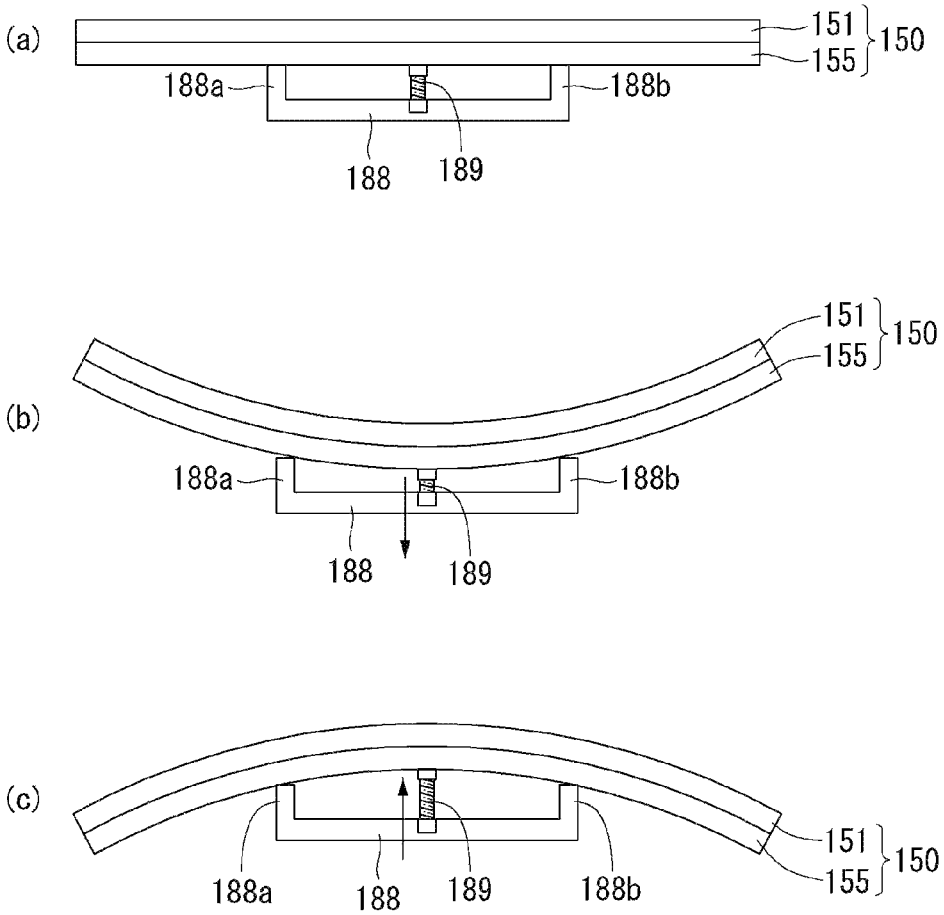
FIG. 15 illustrates a fourth example of a configuration of a curved formation unit according to an example embodiment of the invention.
Figure 16:
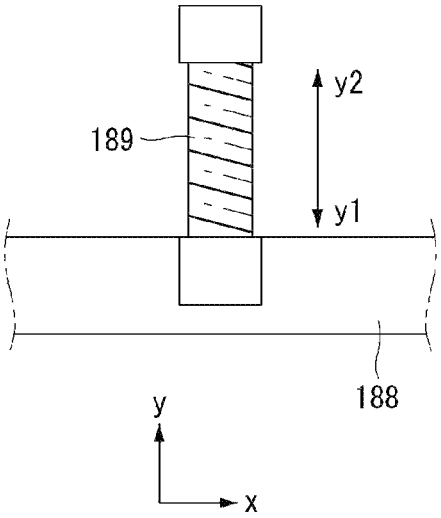
FIG. 16 illustrates an operation of a driver shown in FIG. 15.
Figure 17:
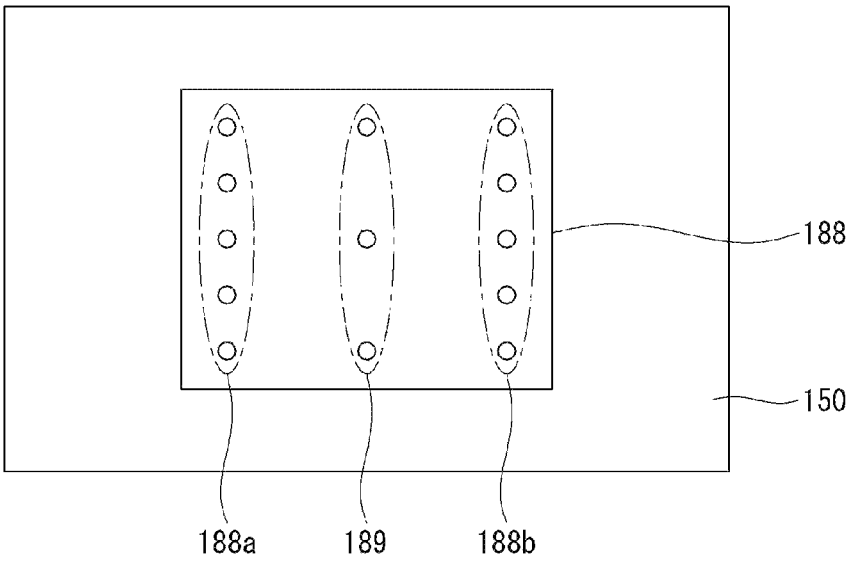
FIG. 17 illustrates an example of installing a supporter and a driver shown in FIG. 15.

FIG. 15 illustrates a fourth example of the configuration of the curved formation unit according to the embodiment of the invention. FIG. 16 illustrates an operation of a driver shown in FIG. 15. FIG. 17 illustrates an example of installing a supporter and the driver shown in FIG. 15.

As shown in FIG. 15, a curved formation unit includes a supporter 188 and a driver 189. The supporter 188 includes fixers 188*a* and 188*b*, which are respectively installed on the left and right sides of the back surface of the flexible display panel 150. The supporter 188 has a combined shape of a T-shape and two L-shapes. The driver 189 is vertically installed on the supporter 188 in the center of the back surface of the flexible display panel 150, so as to vary its length in response to the curved signal.

As shown in FIG. 16, the driver 189 is configured as a device capable of varying its length using a motor manner, an air pressure manner, a fluid pressure manner, etc. When the driver 189 is configured in the motor manner, the driver 189 varies its length by increasing or reducing a length of a screw depending on a rotation direction of a motor. When the driver 189 is configured in the air pressure manner, the driver 189 varies its length by increasing or reducing a length of the screw depending on the air pressure. When the driver 189 is configured in the fluid pressure manner, the driver 189 varies its length by increasing or reducing a length of the screw depending on the fluid pressure. Alternatively, the driver 189 may be configured as various devices capable of varying its length.

As shown in FIGS. 15 and 16, when the curved signal generating unit 170 supplies the second curved signal to the driver 189, the driver 189 reduces its length while the driver 189 is driven in an y1 direction. The driver 189 forms an attractive force as its length decreases. Hence, the surface of the flexible display panel 150 is bent from a flat surface shown in (a) of FIG. 15 to a concave surface shown in (b) of FIG. 15.

On the other hand, when the curved signal generating unit 170 supplies the first curved signal to the driver 189, the driver 189 increases its length while the driver 189 is driven in an y2 direction. The driver 189 forms a propellent force as its length increases. Hence, the surface of the flexible display panel 150 is bent from the flat surface shown in (a) of FIG. 15 to a convex surface shown in (c) of FIG. 15.

As shown in FIG. 17, the supporter 188 including the fixers 188*a* and 188*b* and the driver 189 are in plural, so that they can easily transfer the force applied to the flexible display panel 150. The configuration shown in FIG. 17 is applied to the second and third examples as well as the fourth example of the curved formation unit.

As described above, the flexible display panel 150 has the flexibility, but may be damaged depending on a material of a substrate for protecting an element formed therein and the radius of curvature of the flexible display panel 150. Thus, the structure of the flexible display panel 150 or the structure of the curved formation unit may be determined within a maximum radius of curvature applicable to the flexible display panel 150. For example, the curved formation unit may further include a cushion which is able to reduce an impact of the supporter or the driver of the curved formation unit contacting the flexible display panel 150. Further, the flexible display panel 150 may be configured as follows.

The structure capable of preventing the damage of the flexible display panel 150 is described below.

Figure 18:
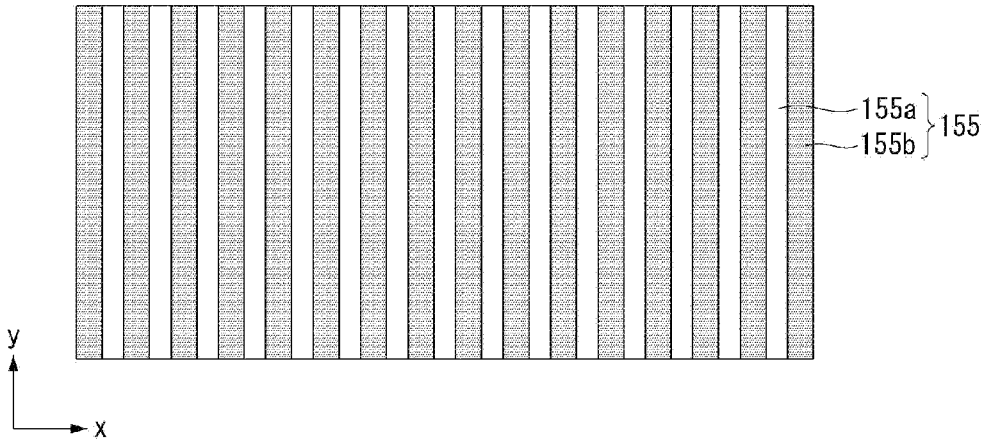
FIG. 18 is a plane view of a back cover attached to a flexible display panel.
Figure 19:
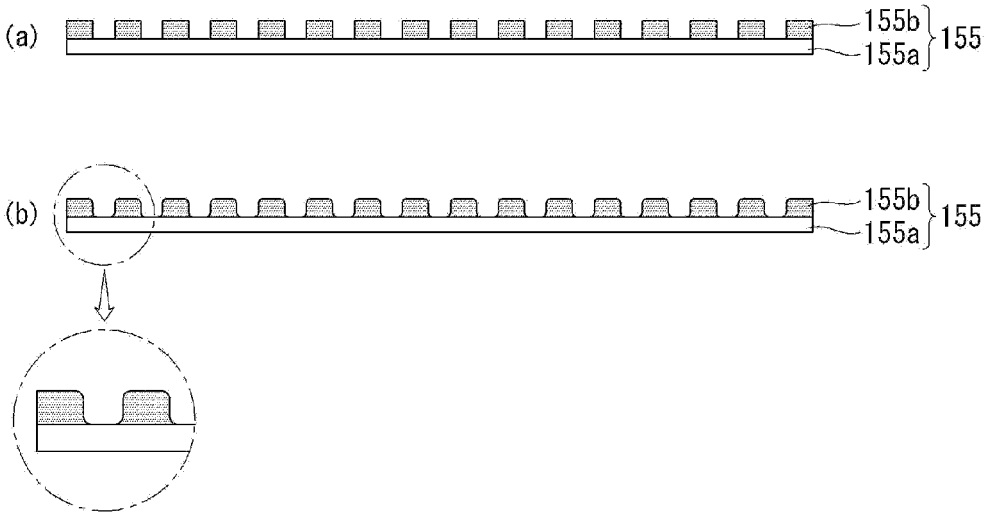
FIG. 19 illustrates a back cover shown in FIG. 18.

FIG. 18 is a plane view of the back cover attached to the flexible display panel. FIG. 19 illustrates the back cover shown in FIG. 18.

As shown in FIG. 18, the back cover 155 of the flexible display panel 150 is configured so that the flexible display panel 150 is easily bent in a long-axis direction 'x' and is not bent in a short-axis direction 'y'. For this, the back cover 155 includes a base plate 155*a* attached to the back surface of the flexible display panel 150 and a plurality of beads 155*b* which are formed on one surface of the base plate 155*a* and are separated from one another in the short-axis direction 'y'. The beads 155*b* have a stripe shape.

Because the beads 155*b* on one surface of the base plate 155*a* are separated from one another in the short-axis direction 'y', the beads 155*b* may support the flexible display panel 150 so that the flexible display panel 150 is not bent in the short-axis direction 'y'.

An edge of each of the beads 155*b* may have a rectangular shape as shown in (a) of FIG. 19 or may have a round shape as shown in (b) of FIG. 19. The rectangular beads 155*b* may provide strong rigidity and good workability. The round beads 155*b* may reduce the accumulation of fatigues of their edges due to the repeated formation of curvature. Further, because an adhesion surface of each round bead 155*b* attached to the base plate 155*a* as well as the edges of the round beads 155*b* have the round shape, a stress of the adhesion surface of each round bead 155*b* when the surface of the flexible display panel 150 is bent may be reduced.

The beads 155*b* may be formed so that the flexible display panel 150 is bent based on the center of the flexible display panel 150. More specifically, the beads 155*b* may be positioned, so that a middle point of the beads 155*b* is the same as a middle point of the base plate 155*a* (or the middle point of the base plate 155*a* is the same as a middle point between the two beads 155*b*). Further, the beads 155*b* may be respectively positioned at both ends of the base plate 155*a*.

The back cover 155 may be formed of aluminum (for example, Al 5052) having thermal conductivity and flexibility for the effective heat dissipation or thermally conductive plastic. Other materials may be used. The thinner the formation material of the back cover 155 is, the better the back cover 155 is. However, it is preferable, but not required, that a thickness of the back cover 155 is equal to or greater than about 1.0 mm in consideration of the rigidity. Because a density of aluminum used in the back cover 155 is less than electrolytic galvanized iron (EGI) or iron-nickel-chrome alloy (Inconel), a weight of aluminum may be reduced. On the other hand, the thermally conductive plastic used in the back cover 155 may be freely designed and may be lighter than a metal such as aluminum.

As described above, the flexible display panel 150 according to the embodiment of the invention is bent to form a concave or convex type. When the flexible display has the large-sized screen, a disposition of a driving device attached to the flexible display panel 150 may be configured as follows, so as to stably form the curved surface of the flexible display panel 150.

The disposition of the driving device for implementing the flexible display is described below.

Figure 20:
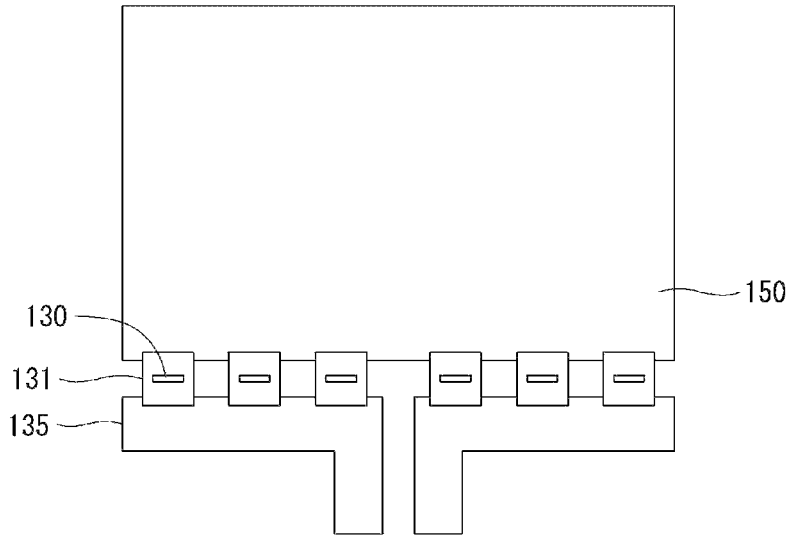
FIG. 20 illustrates a disposition of a driving device for implementing a flexible display according to an example embodiment of the invention.
Figure 20:
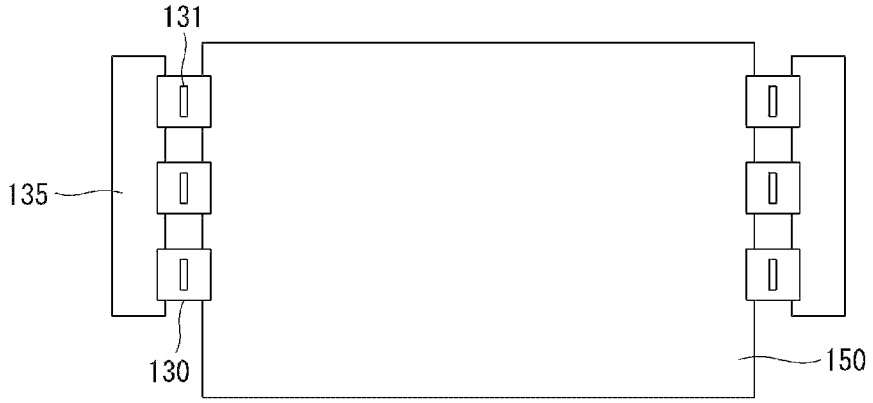

FIG. 20 illustrates a disposition of a driving device for implementing the flexible display according to the embodiment of the invention.

As shown in (a) of FIG. 20, the flexible display panel 150 includes a plurality of first external circuit substrates 131, on which the data driver 130 supplying the data signal to the flexible display panel 150 is mounted, and N second external circuit substrates 135 which are attached to the plurality of first external circuit substrates 131, where N is an integer equal to or greater than 2. The plurality of first external circuit substrates 131 are attached along the long-axis direction of the flexible display panel 150, and the N second external circuit substrates 135 are dividedly disposed based on the middle point, at which the flexible display panel 150 is bent.

A method for attaching and disposing the driving device to and on the flexible display panel 150 is described below.

The plurality of data drivers 130 supplying the data signal to the flexible display panel 150 are respectively mounted on the plurality of first external circuit substrates 131, and the plurality of first external circuit substrates 131 are attached to the flexible display panel 150 along the long-axis direction of the flexible display panel 150. The N second external circuit substrates 135 are dividedly disposed based on the middle point, at which the flexible display panel 150 is bent, and are attached to the first external circuit substrates 131.

Although the first and second external circuit substrates 131 and 135 are attached to the back surface of the flexible display panel 150, the damage of the flexible display panel 150 or the damage of the first and second external circuit substrates 131 and 135 resulting from the formation of the curved surface of the flexible display panel 150 are prevented by disposing the first and second external circuit substrates 131 and 135 as described above. In the embodiment of the invention, a printed circuit board may be selected as the first external circuit substrates 131, and a flexible circuit board may be selected as the second external circuit substrates 135.

As shown in (b) of FIG. 20, the first external circuit substrates 131 are dividedly attached to the left and right sides of the flexible display panel 150 along the short-axis direction of the flexible display panel 150. Further, the N second external circuit substrates 135 are dividedly disposed on the left and right sides of the flexible display panel 150.

A method for attaching and disposing the driving device to and on the flexible display panel 150 is as follows.

The plurality of data drivers 130 supplying the data signal to the flexible display panel 150 are respectively mounted on the plurality of first external circuit substrates 131, and the plurality of first external circuit substrates 131 are dividedly attached to the left and right sides of the flexible display panel 150 along the short-axis direction of the flexible display panel 150. The N second external circuit substrates 135 are dividedly disposed on the left and right sides of the flexible display panel 150 and are attached to the first external circuit substrates 131.

Although the first and second external circuit substrates 131 and 135 are attached to the back surface of the flexible display panel 150, the damage of the flexible display panel 150 or the damage of the first and second external circuit substrates 131 and 135 resulting from the formation of the curved surface of the flexible display panel 150 are prevented by disposing the first and second external circuit substrates 131 and 135 as described above. In the embodiment of the invention, a printed circuit board may be selected as the first external circuit substrates 131, and a printed circuit board or a flexible circuit board may be selected as the second external circuit substrates 135.

FIG. 20 shows the flexible display, in which the gate driver for supplying the gate signal is formed on the flexible display panel 150 in the form of the gate-in panel.

As described above, the embodiment of the invention may automatically or passively form the curved surface of the flexible display panel based on at least one of the external environmental conditions, the displaying image conditions, and the user setting conditions, so as to provide the optimum viewing effect for the viewer. The embodiment of the invention may stably form the curved surface of the flexible display panel through the disposition of the external circuit substrates attached to the flexible display panel. Further, the embodiment of the invention may form the back cover on the back surface of the flexible display panel, thereby securing the rigidity and preventing the stress or the fatigue. The embodiment of the invention may increase a design freedom of the back cover and may manufacture the light flexible display. Because the embodiment of the invention may bend or stretch the flexible display panel based on the mechanical device, the flexible display panel may be stably driven within the maximum radius of curvature. Because the embodiment of the invention may assemble the flexible display panel and the back cover in the flat state, an alignment fail may be prevented or reduced.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A flexible display comprising:

a flexible display panel;

a curved formation unit configured to form a curved surface of the flexible display panel; and a curved signal generating unit configured to supply a curved signal to the curved formation unit so that a radius of curvature of the flexible display panel is controlled based on at least one of user setting conditions, external environmental conditions, and displaying image conditions, wherein the curved formation unit forms the curved surface of the flexible display panel in response to the curved signal, wherein the curved formation unit is positioned at a back side of the flexible display panel, wherein the curved formation unit is configured to form the flexible display panel as a convex type, and is configured to form the flexible display panel as a concave type, wherein when the curved formation unit forms the flexible display panel as the convex type, the flexible display panel is configured to simultaneously display different images towards different viewpoints for different viewers to respectively watch the different images, wherein the flexible display panel includes a display panel displaying an image and a back cover attached to a back surface of the display panel, wherein the back cover includes a base plate attached to a back surface of the flexible display panel and a plurality of beads which are formed on one surface of the base plate, are separated from one another in a short-axis direction, and have a stripe shape, wherein each bead of the plurality of beads includes a first side surface and a second side surface opposite the first side surface, wherein when the flexible display panel is formed as the concave type, the first side surface of a first bead and the second side surface of a second bead adjacent the first bead go away from each other, and wherein when the flexible display panel is formed as the convex type, the first side surface of the first bead and the second side surface of the second bead approach each other.

2. The flexible display of claim 1, wherein the curved formation unit bends and stretches a left portion and a right portion of the flexible display panel based on a middle point of the flexible display panel or bends and stretches the middle point of the flexible display panel in response to the curved signal.

3. The flexible display of claim 1, wherein the external environment conditions include at least one of a position of a viewer which watches the flexible display panel, the number of viewers, a position of an outermost viewer adjacent to the viewer, a position of another viewer closest to the viewer, and an ambient brightness of the flexible display panel, wherein the displaying image conditions include a kind of image displayed on the flexible display panel.

4. The flexible display of claim 1, wherein the curved formation unit includes:

connectors which are dividedly positioned on the left and right sides of a back surface of the flexible display panel; and a driver configured to vary a length of the driver in response to the curved signal so that tension of the connectors is varied.

5. The flexible display of claim 4, wherein the driver varies the length of the driver using at least one of a motor manner, a vapor pressure manner, and a fluid pressure manner.

6. The flexible display of claim 1, wherein the curved formation unit includes:

supporters which are dividedly positioned on the left and right sides of a back surface of the flexible display panel; and a driver including a fixer, of which a portion is fixed to the center of the back surface of the flexible display panel, the driver bending and stretching the supporters in response to the curved signal.

7. The flexible display of claim 6, wherein the driver bends and stretches the supporters using at least one of a motor manner, a vapor pressure manner, and a fluid pressure manner.

8. The flexible display of claim 1, wherein the curved formation unit includes:

a supporter including a fixer, of which a portion is fixed to the center of a back surface of the flexible display panel; and drivers which are dividedly positioned on the left and right sides of the back surface of the flexible display panel and are vertically positioned on the supporter to vary a length of each driver in response to the curved signal.

9. The flexible display of claim 1, wherein the curved formation unit includes:

a supporter including fixers, which are dividedly positioned on the left and right sides of a back surface of the flexible display panel; and a driver which is vertically installed on the supporter in the center of the back surface of the flexible display panel and varies a length of the driver in response to the curved signal.

10. The flexible display of claim 1, wherein an edge of each of the plurality of beads has a rectangular shape or a round shape.

11. The flexible display of claim 1, wherein the flexible display panel includes:

a plurality of first external circuit substrates, on which a data driver supplying a data signal to the flexible display panel is mounted; and N second external circuit substrates attached to the plurality of first external circuit substrates, where N is an integer equal to or greater than 2, wherein the plurality of first external circuit substrates are attached to a bottom side of the flexible display panel along a long-axis direction of the flexible display panel, the bottom side of the display panel being perpendicular to a middle axis at which the flexible display panel is bent, wherein the first external circuit substrates and the N second external circuit substrates are dividedly disposed on opposite sides of the middle axis.

12. The flexible display of claim 1, wherein the flexible display panel includes:

a plurality of first external circuit substrates, on which a data driver supplying a data signal to the flexible display panel is mounted; and N second external circuit substrates attached to the plurality of first external circuit substrates, where N is an integer equal to or greater than 2, wherein the plurality of first external circuit substrates are dividedly attached to the left and right sides of the flexible display panel along a short-axis direction of the flexible display panel, wherein the N second external circuit substrates are dividedly disposed on the left and right sides of the flexible display panel.

* * * * *